US008168573B2

(12) United States Patent
Moriki et al.

(10) Patent No.: US 8,168,573 B2
(45) Date of Patent: May 1, 2012

(54) LUBRICATING OIL COMPOSITION

(75) Inventors: Keiichi Moriki, Tokyo (JP); Eiji Nagatomi, Tokyo (JP); Kenji Ueno, Toyota (JP); Koji Saito, Toyota (JP); Kiyonari Ishikawa, Toyota (JP); Hiroshi Fujito, Toyota (JP)

(73) Assignee: Shell Oil Company, Houston, TX (US)

( * ) Notice: Subject to any disclaimer, the term of this patent is extended or adjusted under 35 U.S.C. 154(b) by 129 days.

(21) Appl. No.: 12/521,227

(22) PCT Filed: Dec. 24, 2007

(86) PCT No.: PCT/IB2007/004091

§ 371 (c)(1), (2), (4) Date: Sep. 15, 2009

(87) PCT Pub. No.: WO2008/081287

PCT Pub. Date: Jul. 10, 2008

(65) Prior Publication Data

US 2010/0087348 A1 Apr. 8, 2010

(30) Foreign Application Priority Data

Dec. 27, 2006 (JP) ..... 2006-352429

(51) Int. Cl.

| | |
|---|---|
| ***C10M 111/04*** | (2006.01) |
| ***C10M 173/02*** | (2006.01) |
| ***C10M 169/04*** | (2006.01) |

(52) U.S. Cl. ..... 508/499; 508/314; 508/450

(58) Field of Classification Search ..... 508/314, 508/450, 486, 499

See application file for complete search history.

(56) References Cited

U.S. PATENT DOCUMENTS 4,956,122 A * 9/1990 Watts et al. ..... 508/485

FOREIGN PATENT DOCUMENTS

| | | |
|---|---|---|
| EP | 578435 | 1/1994 |
| JP | 2004323850 | 11/2004 |
| WO | WO9804658 | 2/1998 |
| WO | WO03091369 | 11/2003 |

* cited by examiner

*Primary Examiner* — Walter D Griffin
*Assistant Examiner* — Francis C Campanell

(57) ABSTRACT

The present invention provides a lubricating oil composition comprising a mixture of both a poly-alpha-olefin and an ester compound, the lubricating oil composition having an SAE viscosity grade of 75W-85, satisfying GL-5 in terms of API gear oil designation and having a viscosity index of 160 or more. The above mixture of the poly-alpha-olefin and ester compound is preferably contained in an amount of from 75 to 90 wt % with reference to the total amount of the lubricating oil composition. The poly-alpha-olefin is preferably a mixture of a poly-alpha-olefin having low viscosity of from about 3 to 6 $mm^2/s$ at 100° C. and a poly-alpha-olefin having high viscosity of from about 35 to 45 $mm^2/s$ at 100° C.

5 Claims, No Drawings

LUBRICATING OIL COMPOSITION the present application claims priority from PCT/IB2007/004091, filed 25 Dec. 2007, which claims priority from Japanese Patent Application 2006-3352429 filed 27 December.

The present invention relates to a lubricating oil composition and in particular relates to a lubricating oil composition that is employed as an automobile gear oil, or as an automobile hypoid gear oil.

BACKGROUND OF THE INVENTION

In recent years, with respect to withstand load performance required in a gear oil for automobiles, levels of from GL-4 to GL-5 in terms of gear oil designation by the API (American Petroleum Institute) are being required, as a result of increased automobile power.

In gear oils required to have such durability, for the purpose of maintaining an oil film on the gear tooth flanks, it was common to employ oil of viscosity No. 90 (13.5 to 24.0 $mm^2/s$ (100° C.)) as defined by the SAE (Society of Automotive Engineers).

However, on the other hand, fuel consumption saving is also required; for the purpose of realizing this, the resistance to stirring must be reduced; and in order to achieve this, it is required to make the viscosity low.

In order to meet both of these requirements, namely, of maintaining the action of forming an oil film on the gear tooth flanks and of making the viscosity low, if the conventional technique is adopted of increasing the amount of extreme pressure additives added to a base oil of low viscosity, there is a high risk that phosphorus or sulfur-based additives used as the extreme pressure additive may have the adverse effect of increasing corrosion of parts containing a copper constituent, thereby shortening the life of the equipment. Accordingly, an additive composition for gear oil capable of reducing the corrosion of such copper or copper alloys has also been proposed. See JP-A No. 2004-323850.

SUMMARY OF THE INVENTION

The present invention aims to provide a lubricating oil composition capable of being applied to a gear oil for automobiles, or a hypoid gear oil, etc., which is able to prevent the generation of fretting wear generated due to microvibration and to realize fuel consumption saving while maintaining excellent durability, seizure resistance and stability of the level of API-GL-5 applicable as a gear oil for gear mechanisms for high power and high rotational speed in high-power automobiles or the like.

DETAILED DESCRIPTION OF PREFERRED EMBODIMENTS

According to the present invention, a lubricating oil composition is obtained by employing a mixture of both a poly-alpha-olefin and an ester compound, the lubricating oil composition having an SAE viscosity grade of 75 W-85, satisfying GL-5 in terms of API gear oil designation and having a viscosity index of 160 (ASTM D2270) or more.

The mixture of both the poly-alpha-olefin and the ester compound is preferably used in an amount of from 75 to 90 wt % with respect to the total amount of the lubricating oil composition.

The poly-alpha-olefin is preferably a mixture of low-viscosity poly-alpha-olefin having a kinetic viscosity of about from 3 to 6 $mm^2/s$ at 100° C. (ASTM D445) and high-viscosity poly-alpha-olefin having a kinetic viscosity of about from 35 to 45 $mm^2/s$ at 100° C. (ASTM D445). The low-viscosity poly-alpha-olefin is preferably contained in an amount of more than half of the total poly-alpha-olefins.

Also, the ester compound is preferably an ester compound having a kinetic viscosity of from 3 to 6 $mm^2/s$ at 100° C. (ASTM D445) and is preferably contained in an amount of not more than 20 wt % in the total amount of the composition.

With the present invention, a lubricating oil composition is obtained that is capable of being applied as a gear oil to gear mechanisms of high power and high rotational speed such as high-power automobiles and the like, that can maintain seizure resistance and stability of the high level of API-GL-5, while preventing generation of fretting wear produced by micro vibration, enabling excellent durability to be obtained, and achieving fuel consumption saving: this lubricating oil composition can thus be effectively employed as an automobile gear oil or hypoid gear oil etc.

Fuel consumption saving in respect of a gear mechanism is chiefly achieved by a careful balance of: (1) reduction of sliding between gear flanks occurring on contact with other metal members; (2) reduction of the energy required for stirring of the lubricating oil by the rotating gear wheels; and (3) reduction of sliding friction under high-pressure conditions occurring between gear flanks with a film of lubricating oil interposed therebetween.

The means normally considered for achieving such a balance are: to lower the coefficient of friction by effective utilization of an oily agent added for the purpose of (1) above; to lower the viscosity by choosing a low-viscosity base oil for the purpose of (2) above; or to lower the traction coefficient by selection of a base oil of small shearing force for the purpose of (3) above.

Also, in order to improve the withstand load performance, it is desired for example (4) to form a tough metallic coating on the gear flanks by use of an extreme pressure agent or (5) to form an oily film so as to prevent metal-to-metal contact.

In order to achieve both fuel consumption saving and withstand load performance, an important point is first of all to select the chief constituent materials of the lubricating oil composition. Specifically, constituent materials are preferred that have a low stirring resistance due to low viscosity at low temperature, but high viscosity in the extreme pressure condition generated at high temperature.

Compositions that are close to such a desirable composition have a high viscosity index (VI) that shows little change of viscosity with temperature: the VI value must be at least 140, preferably at least 150 and particularly preferably at least 160.

As a result of various studies and tests concerning methods of improving this VI, the present inventors discovered that an effective means of achieving this is to employ a mixture of poly-alpha-olefins of low viscosity and poly-alpha-olefins of high viscosity.

Also, when measurement of the oily film thickness and measurement of the traction coefficient were conducted in respect of compositions of various types, it was found that (5) in the case of paraffin-based mineral oils, the oily film thickness was about 50 to 230 mm (nanometres) and the traction coefficient about 0.03 to 0.044; (6) in the case of naphthene-based mineral oils, the oily film thickness was about 100 to 380 nm (nanometres) and the traction coefficient about 0.019 to 0.028; and (7) in the case of paraffin-based synthetic oil and ester synthetic oil, the oily film thickness was about 70 to 320 nm (nanometres) and the traction coefficient about 0.007 to 0.014. From the above, in order to obtain low traction, it was found that it was preferable to employ the paraffin-based synthetic oil and ester compound (ester synthetic oil) of (7) above.

Three groups of compounds, namely, poly-alpha-olefins, GTL (i.e. Fischer-Tropsch derived) oil and ester compounds could be selected as candidates for the above paraffin-based synthetic oil and ester compound of (7) above.

Of this group, it was found that the use of ester compounds was most effective, since they showed the lowest traction coefficient and additionally enable an oily effect to be obtained.

However, it is found that these ester compounds are liable to hydrolysis and generate competitive adsorption onto the metal surface with extreme pressure additives: they cannot therefore be included in large quantity in lubricating oil compositions, the maximum being about 40 wt %, preferably about 5 to 20 wt %.

Thus, it was found that it was most effective to employ a mixture of poly-alpha-olefins and ester compounds as the constituent materials of the lubricating oil composition. The mixture of these poly-alpha-olefins and ester compounds is preferably in the range about 75 to 90 wt % with respect to the total amount of the lubricating oil composition.

Also, for the above poly-alpha-olefins, it is effective, in order to improve the VI, to employ a mixture of poly-alpha-olefins of low viscosity i.e. of kinetic viscosity 3 to 6 $mm^2/s$ at 100° C. and poly-alpha-olefins of high viscosity i.e. of kinetic viscosity 35 to 45 $mm^2/s$ at 100° C.: furthermore, preferably the above low-viscosity poly-alpha-olefins are employed in an amount of more than half of the total amount of poly-alpha-olefins.

The above poly-alpha-olefins (PAO) include various types of alpha-olefin polymers or hydrides thereof. Any desired alpha-olefins may be employed: examples that may be given include alpha-olefins of carbon number 5 to 19 such as ethylene, propylene, or butene. Regarding the manufacture of the poly-alpha-olefins, a single type of the above alpha-olefins may be employed on its own, or two or more types may be employed in combination.

Poly-alpha-olefins of various different viscosities may be obtained, depending on the type of alpha-olefins used and their degree of polymerization, so the above low-viscosity poly-alpha-olefins and high-viscosity poly-alpha-olefins are used in combination.

When the above two types of poly-alpha-olefin are used in combination, preferably the amount of the low-viscosity poly-alpha-olefin used is greater than the amount of high-viscosity poly-alpha-olefin: in this way, effective fuel consumption saving and load withstanding ability can be obtained.

As the above ester compound, preferably a polyol ester, a di-ester or a combination thereof is employed.

As ester compounds di-esters and/or polyol esters are favourably used. As examples of di-esters are the reactants of dibasic acid (such as Oxalic acid, Malonic acid, Succinic acid, Glutaric acid, Adipic acid, Pimelic acid, Suberic acid, Azelaic acid and Sebacic acid) and monohydroxy straight or branch hydrocarbon chain type alcohol (such as ethanol, propanol, butanol, pentanol, hexanol, heptanol, octanol, nonanol and decanol). For instance, DOS (di-octyl sebacate) is commercially available di-ester.

Suitable polyol esters comprise fatty acid esters obtained from at least one selected from the group of neopentyl polyols of value 2 to 4 and their ethylene oxide adducts, and fatty acids of carbon number 4 to 12. Hereinbelow, neopentyl polyols of value 2 to 4 and their ethylene oxide adducts will be described sequentially.

Specific examples of polyols that may be mentioned include diols such as: ethylene glycol, 1,3-propane diol, propylene glycol, 1,4-butane diol, 1,2-butane diol, 2-methyl-1,3-propane diol, 1,5-pentane diol, neopentyl glycol, 1,6-hexane diol, 2-ethyl-2-methyl-1,3-propane diol, 1,7-heptane diol, 2-methyl-2-propyl-1,3-propane diol, 2,2-diethyl-1,3-propane diol, 1,8-octane diol, 1,9-nonane diol, 1,10-decane diol, 1,11-undecane diol, and 1,12-dodecane diol.

Specific examples of polyols having more than 2 hydroxide groups include: trimethylol ethane, trimethylol propane, trimethylol butane, di-(trimethylol propane), tri-(trimethylol propane), pentaerythritol, di-(pentaerythritol), tri-(pentaerythritol), glycerin, polyglycerin (2-20 glycerin monomers), 1,3,5-pentaerythritol, sorbitol, sorbitane, sorbitol glycerin condensate, adonitol, arabitol, xylitol and mannitol or the like polyhydric alcohols, and sugars such as xylose, arabinose, ribose, rhamnose, glucose, fructose, galactose, mannose, sorbose, cellobiose, maltose, isomaltose, trehalose, sucrose, raffinose, gentianose, and melezitose, and partial ether compounds and methyl glucosides (glycosides) of these.

The above neopentyl polyol ethylene oxide adducts may be obtained by addition of ethylene oxide in the ratio of 1 to 4 mols, preferably 1 to 2 mols, to the above neopentyl polyol. Preferred examples are ethylene oxide adducts of neopentyl glycol, trimethylol propane, or pentaerythritol. If the number of added mols exceeds 4 mols, the heat resistance of the fatty acid ester obtained is adversely affected.

The above neopentyl polyols of value 2 to 4 and their ethylene oxide adducts may be employed alone, or as a mixture of two or more thereof.

As described above, the fatty acids employed in the present invention are fatty acids of carbon number 4 to 12, preferably 5 to 10. If fatty acids of carbon number 3 or less are employed, the anti-wear effect of the ester obtained may be insufficient. On the other hand, if fatty acids of carbon number exceeding 12 are employed, the low-temperature fluidity of the ester obtained may be inferior.

These fatty acids may be selected in the range of the above carbon numbers such that the total number of carbons originating from fatty acids in one molecule of the fatty acid ester obtained is 10 to 22, in accordance with the number of hydroxyl groups in the molecule of the neopentyl polyol or ethylene oxide adduct thereof that is employed.

There is no particular restriction regarding the above fatty acids and saturated fatty acids, unsaturated fatty acids and mixtures of these etc may be employed; furthermore, these fatty acids may be straight-chain fatty acids or branched fatty acids, or mixtures of these. Examples of saturated fatty acids that may be given include saturated fatty acids containing at least 50 mol % of straight-chain saturated fatty acids or saturated fatty acids containing at least 50 mol % of branched-chain saturated fatty acids. Straight-chain saturated fatty acids are usually preferable on account of the stability of the fatty acid esters obtained at high temperature and on account of a high viscosity index, having suitable viscosity for use as a lubricating oil, etc.

A single type of fatty acid may be employed on its own, or a mixture of two or more types of fatty acid may be employed.

Examples of the above straight-chain saturated fatty acids that may be given include: lactic acid, pentanoic acid, caproic acid, heptanoic acid, caprylic acid, pelargonic acid, capric acid, undecanoic acid, and lauric acid.

The fatty acid ester used as a constituent of the composition according to the present invention may be obtained by reacting in any desired ratio a fatty acid and at least one selected from the group consisting of the above neopentyl polyols of value 2 to 4 and their ethylene oxide adducts. Preferably the fatty acid ester is obtained by reacting fatty acid in a ratio of about 2 to 6 mols, more preferably about 2.1 to 5 mols, with respect to one mol of this neopentyl polyol or adduct thereof.

In the above fatty acid ester, at least 50 wt %, preferably at least 60 wt % of this fatty acid ester is fatty acid ester wherein the number of carbon atoms originating from fatty acids is a total of 10 to 22 per molecule. Fatty acid ester having such a composition has an anti-wear effect and heat resistance, high viscosity index and excellent shearing stability. In the case of fatty acid esters wherein the total number of carbon atoms originating from fatty acids per molecule is less than 10, the anti-wear effect and heat resistance are inferior; in the case of fatty acid esters wherein the total number of carbon atoms originating from fatty acids per molecule is more than 22, shearing stability may be inferior and a high viscosity index may be difficult to obtain.

In the present invention, from the above ester compounds, ester compounds whose viscosity at 100° C. is 3 to 6 $mm^2/s$ are selected, and employed in the amount of no more than 20 wt % of the total amount of the composition.

In order to further improve performance, apart from the constituents mentioned above, various types of additives may be suitably selected as required. Examples of these that may be mentioned include: extreme pressure agents: viscosity index improving agents, antioxidants, metal deactivators, or oiliness improvers, anti-foaming agents, pour-point depressants, cleaning and dispersing agents, anti-rust agents, anti-emulsifiers etc and other known lubricating oil additives.

As the above extreme pressure agents, sulfur-based extreme pressure agents or phosphorus compounds or combinations of these, or phosphorothionates etc may be employed.

As sulfur-based extreme pressure agents, hydrocarbon sulfides represented by the following general formula (1), terpene sulfides, and oil/fat sulfides which are the reaction product of oil/fat and sulfur etc may be employed.

$$R_1—S_y-(R_3—S_y)_n-R_2 \quad (1)$$

where, in the above formula (1), $R_1$, $R_2$ are univalent hydrocarbon groups, which may be the same or different, $R_3$ is a divalent hydrocarbon group, y is an integer of one or more, preferably 1 to 8, and y may be the same or different in respective repetition units, and n is an integer which may be 0 or 1 or more.

As the above univalent hydrocarbon groups $R_1$ and $R_2$, there may be mentioned by way of example straight-chain or branched saturated or unsaturated aliphatic hydrocarbon groups of carbon number 2 to 20 (e.g. alkyl groups or alkenyl groups), or aromatic hydrocarbon groups of carbon No. 6 to 26, such as, specifically, an ethyl group, propyl group, butyl group, nonyl group, dodecyl group, propenyl group, butenyl group, benzyl group, phenyl group, tolyl group, or hexyl phenyl group.

As the above divalent hydrocarbon group $R_3$, there may be mentioned by way of example straight-chain or branched saturated or unsaturated aliphatic hydrocarbon groups of carbon number 2 to 20 or aromatic hydrocarbon groups of carbon number 6 to 26, such as specifically, an ethylene group, propylene group, butylene group, or phenylene group.

As typical examples of hydrocarbon sulfides represented by the above general formula (1), there may be mentioned sulfur olefins and polysulfide compounds represented by the general formula (2).

$$R_1—S_y-R_2 \quad (2)$$

where, in the above general formula (2), $R_1$ and $R_2$ are the same as in the case of the general formula (1), and y is an integer of 2 or more.

Specific examples of these that may be given include sulfur diisobutyl disulfide, dioctyl polysulfide, di-tertiary nonyl polysulfide, di-tertiary butyl polysulfide, di-tertiary benzyl polysulfide, or olefin sulfides obtained by sulfurizing with a sulfurizing agent olefins such as poly-isobutylene or terpene.

Specific examples of the above phosphorothionates that may be mentioned include: tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyl diphenyl phosphorothionate, xylenyl diphenyl phosphorothionate, tris(n-propylphenyl) phosphorothionate, tris(isopropylphenyl) phosphorothionate, tris(n-butylphenyl) phosphorothionate, tris(isobutylphenyl) phosphorothionate, tris(s-butylphenyl) phosphorothionate, or tris (t-butylphenyl) phosphorothionate.

Also, a phosphorus compound may be employed in order to confer extreme pressure performance or anti-wear performance. Examples of phosphorus compounds that may be applied in the present invention include: phosphoric acid esters, acid phosphoric acid esters, amine salts of acid phosphoric acid esters, chlorinated phosphoric acid esters, phosphorous acid esters, phosphorothionates, zinc dithiophosphate, esters of dithiophosphoric acid and an alkanol or polyether type alcohol and derivatives thereof, phosphorus-containing carboxylic acids, or phosphorus-containing carboxylic acid esters.

As the above phosphoric acid esters, examples that may be given include: tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, or triphenyl phosphate, tris(isopropylphenyl) phosphate, triallyl phosphate, tricresyl phosphate, trixylenyl phosphate, cresyl diphenyl phosphate, or xylenyl diphenyl phosphate.

Specific examples of the above acid phosphoric acid esters that may be given include: monobutyl acid phosphate, monopentyl acid phosphate, monohexyl acid phosphate, monoheptyl acid phosphate, mono-octyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, mono-octadecyl acid phosphate, mono-oleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate or dioleyl acid phosphate.

As the amine salts of acid phosphoric acid esters, there may be mentioned for example salts of the acidic phosphoric acid esters with amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine and trioctylamine.

As the phosphorous acid esters there may be mentioned for example dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite, or tricresyl phosphite.

The above extreme pressure agents may be employed either alone or in the form of a suitable mixture. These extreme pressure agents may be employed in an added amount of about 5 to 15 wt % in the total amount of the lubricating oil composition. Also, it is convenient in managing product quality to employ an extreme pressure additive package constituted by a mixture of a selected sulfur-based compound and phosphorus-based compound. Examples that may be mentioned include Anglamol 99, 98A or 6043 of Lubrizol Inc and the H340 or H380 series of Afton Inc.

In order to improve viscosity performance and low temperature fluidity in respect of the lubricating oil composition of the present invention, viscosity index improvers or pour-point depressants may be added.

Examples of viscosity index improvers that may be given include polymethacrylate or ethylene-propylene copolymer, ethylene-diene copolymer, non-dispersive viscosity index improvers such as poly-isobutylene, polystyrene or the like olefin polymers, or dispersive viscosity index improvers obtained by copolymerization of these with a nitrogen-containing monomer. The added amounts thereof that may be used are in the range 0.5 to 15 wt. % with respect to the total amount of the composition.

Also, examples of pour-point depressants that may be mentioned are polymethacrylate-based polymers. These may be used with an added amount in the range 0.01 to 5 wt % with respect to 100 wt % of the lubricating oil composition.

As antioxidants employed in the present invention, antioxidants used for lubricating oils are practically preferable: examples that may be given include phenol-based antioxidants, amine-based antioxidants and sulfur-based antioxidants. These antioxidants may be employed either alone or as a combination of two or more, in a range of 0.01 to 5 wt % with respect to 100 wt % of the lubricating oil composition.

Examples of the amine-based antioxidants that may be given include: dialkyl diphenylamines such as p, p'-dioctyl diphenylamine (manufactured by Seiko Chemicals Inc: Nonflex OD-3), p, p'-di-α-methylbenzyl diphenylamine, or N-p-butylphenyl-N-p'-octylphenylamine; monoalkyl diphenylamines such as mono-t-butyl diphenylamine or mono-octyl diphenylamine; bis(dialkylphenyl)amines such as di(2,4-diethylphenyl)amine, or di(2-ethyl-4-nonylphenyl)amine; alkylphenyl-1-naphthylamines such as octylphenyl-1-naphthylamine or N-t-dodecylphenyl-1-naphthylamine; arylnaphthylamines such as 1-naphthylamine, phenyl-1-naphthylamine, phenyl-2-naphthylamine, N-hexylphenyl-2-naphthylamine, or N-octylphenyl-2-naphthylamine; phenylene diamines such as N,N'-diisopropyl-p-phenylenediamine, or N,N'-diphenyl-p-phenylenediamine; or phenothiazines such as phenothiazine (manufactured by Hodogaya Chemicals Inc: Phenothiazine) or 3,7-dioctyl phenothiazine.

Examples of the sulfur-based antioxidants that may be given include: dialkyl sulfides such as didodecyl sulfide or dioctadecyl sulfide, thiodipropionic acid esters such as didodecyl thiodipropionate, dioctadecyl thiodipropionate, dimyristyl thiodipropionate, or dodecyl octadecyl thiodipropionate, or 2-mercapto benzoimidazole.

Examples of the phenol-based antioxidants that may be given include 2-t-butyl phenol, 2-t-butyl-4-methyl phenol, 2-t-butyl-5-methyl phenol, 2,4-di-t-butyl phenol, 2,4-dimethyl-6-t-butyl phenol, 2-t-butyl-4-methoxy phenol, 3-t-butyl-4-methoxy phenol, 2,5-di-t-butyl hydroquinone (manufactured by Kawaguchi Chemicals Inc: Antage DBH), 2,6-di-t-butyl phenol, 2,6-di-t-butyl-4-alkyl phenols, such as 2,6-di-t-butyl-4-methyl phenol, or 2,6-di-t-butyl-4-ethyl phenol; or 2,6-di-t-butyl-4-alkoxy phenols such as 2,6-di-t-butyl-4-methoxy phenol or 2,6-di-t-butyl-4-ethoxy phenol.

Further examples include alkyl-3-(3,5-di-t-butyl-4-hydroxy phenyl) propionates such as 3,5-di-t-butyl-4-hydroxybenzyl mercapto-octyl acetate, n-octadecyl-3-(3,5-di-t-butyl-4-hydroxy phenyl) propionate (manufactured by Yoshitomi Seiyaku Inc: Yoshinox SS), n-dodecyl-3-(3,5-di-t-butyl-4-hydroxyphenyl) propionate, 2'-ethylhexyl-3-(3,5-di-t-butyl-4-hydroxyphenyl) propionate, or benzene propanoate 3,5-bis(1,1-dimethyl-ethyl)-4-hydroxy-C7 to C9 side-chain alkyl ester (manufactured by Ciba Speciality Chemicals Inc: Irganox L135), or 2,2'-methylene bis(4-alkyl-6-t-butylphenol) such as 2,6-di-t-butyl-α-dimethylamino-p-cresol, 2,2'-methylene bis(4-methyl-6-t-butylphenol) (manufactured by Kawaguchi Chemicals Inc: Antage W-400), or 2,2'-methylene bis(4-ethyl-6-t-butylphenol) (manufactured by Kawaguchi Chemicals: Antage W-500).

Yet further examples include bisphenols such as 4,4'-butylidene bis(3-methyl-6-t-butylphenol) (manufactured by Kawaguchi Chemicals Inc: Antage W-300), 4,4'-methylene bis(2,6-di-t-butylphenol) (manufactured by Shell Japan Inc: Ionox 220 AH), 4,4'-bis(2,6-di-t-butylphenol), 2,2-(di-p-hydroxyphenyl) propane (manufactured by Shell Japan Inc: bisphenol A), 2,2-bis(3,5-di-t-butyl-4-hydroxyphenyl)propane, 4,4'-cyclohexylidene bis(2,6-t-butylphenol), hexamethylene glycol bis[3-(3,5-di-t-butyl-4-hydroxyphenyl) propionate] (manufactured by Ciba Speciality Chemicals Inc: Irganox L109), triethylene glycol bis[3-(3-t-butyl-4-hydroxy-5-methyl phenyl)propionate] (manufactured by Yoshitomi Chemicals Inc: Tominox 917), 2,2'-thio-[diethyl-3-(3,5-di-t-butyl-4-hydroxyphenyl)propionate] (manufactured by Ciba Speciality Chemicals Inc: Irganox L 115), 3,9-bis{1,1-dimethyl-2-[3-(3-t-butyl-4-hydroxy-5-methylphenyl)propionyloxy]ethyl}2,4,8,10-tetraoxaspiro[5,5]undecane (Sumitomo Chemicals: Sumilizer GA80), or 4,4'-thiobis(3-methyl-6-t-butylphenol) (manufactured by Kawaguchi Chemicals Inc: Antage RC), or 2,2'-thiobis(4,6-di-t-butylresorcin).

Further examples that may be given also include polyphenols, such as tetrakis[methylene-3-(3,5-di-t-butyl-4-hydroxyphenyl) propionate]methane (manufactured by Ciba Speciality Chemicals Inc: Irganox L 101), 1,1,3-tris(2-methyl-4-hydroxy-5-t-butylphenyl)butane (manufactured by Yoshitomi Chemicals Inc: Yoshinox 930), 1,3,5-trimethyl-2,4,6-tris(3,5-di-t-butyl-4-hydroxybenzyl)benzene (manufactured by Shell Japan Inc: Ionox 330), bis-[3,3'-bis-(4'-hydroxy-3'-t-butylphenyl)butyric acid]glycol ester, 2-(3',5'-di-t-butyl-4-hydroxyphenyl)methyl-4-(2",4"-di-t-butyl-3"-hydroxyphenyl)methyl-6-t-butylphenol, or 2,6-bis(2'-hydroxy-3'-t-butyl-5'-methyl-benzyl)-4-methylphenol, or phenol/aldehyde condensation products such as the condensation product of p-t-butylphenol and formaldehyde or the condensation product of p-t-butylphenone and acetaldehyde.

Examples of the phosphorus-based antioxidants that may be given include triaryl phosphites such as triphenyl phosphite, or tricresyl phosphite, trialkyl phosphites such as trioctadecyl phosphite, or tridecyl phosphite, or tridodecyl trithiophosphite.

Metal deactivators that may be used together with the composition according to the present invention include benzotriazole, 4-alkyl-benzotriazoles such as 4-methyl-benzotriazole, or 4-ethyl-benzotriazole, 5-alkyl-benzotriazoles such as 5-methyl-benzotriazole, or 5-ethyl-benzotriazole, 1-alkyl-benzotriazoles such as 1-dioctyl-aminomethyl-2,3-benzotriazole, benzotriazole derivatives such as 1-alkyl-tolutriazoles such as 1-dioctyl aminomethyl-2,3-tolutriazole, benzoimidazole, 2-(alkyl dithio)-benzoimidazoles such as 2-(octyl dithio)-benzoimidazole, 2-(decyl dithio)-benzoimidazole, or 2-(dodecyl dithio)-benzoimidazole, or benzoimidazole derivatives such as 2-(alkyldithio)-toluimidazoles such as 2-(octyl dithio)-toluimidazole, 2-(decyl dithio)-toluimidazole, or 2-(dodecyl dithio)-toluimidazole.

Further examples include indazole or indazole derivatives such as toluindazoles such as 4-alkyl-indazoles or 5-alkyl-indazoles, benzothiazole, or benzothiazole derivatives such as 2-mercapto benzothiazole (Chiyoda Chemicals Inc: Thiolite B-3100), 2-(alkyl dithio) benzothiazoles such as 2-(hexyl dithio) benzothiazole or 2-(octyl dithio) benzothiazole, 2-(alkyl dithio) toluthiazoles such as 2-(hexyl dithio) toluthiazole or 2-(octyl dithio) toluthiazole, 2-(N,N-dialkyl dithiocarbamyl) benzothiazoles such as 2-(N,N-diethyl dithiocarbamyl) benzothiazole, 2-(N,N-dibutyl dithiocarbamyl) benzothiazole or 2-(N,N-dihexyl dithiocarbamyl) benzothiazole, or 2-(N,N-dialkyl dithiocarbamyl) toluthiazoles such as 2-(N,N-diethyl dithiocarbamyl) toluthiazole, 2-(N,N-dibutyl dithiocarbamyl) toluthiazole or 2-(N,N-dihexyl dithiocarbamyl) toluthiazole.

Yet further examples include benzo-oxazole derivatives such as 2-(alkyl dithio)-benzo-oxazoles such as 2-(octyl dithio) benzo-oxazole, 2-(decyl dithio) benzo-oxazole, or 2-(dodecyl dithio) benzo-oxazole, or 2-(alkyl dithio)-toluoxazoles such as 2-(octyl dithio) toluoxazole, 2-(decyl dithio) toluoxazole, or 2-(dodecyl dithio) toluoxazole, thiadiazole derivatives such as 2,5-bis(alkyl dithio)-1,3,4-thiadiazoles such as 2,5-bis(heptyl dithio)-1,3,4-thiadiazole, 2,5-bis(nonyl dithio)-1,3,4-thiadiazole, 2,5-bis(dodecyl dithio)-1,3,4-thiadiazole or 2,5-bis(octadecyl dithio)-1,3,4-thiadiazole, such as 2,5-bis(N,N-dialkyl dithiocarbamyl)-1,3,4-thiadiazoles such as 2,5-bis(N,N-diethyl dithiocarbamyl)-1,3,4-thiadiazole, 2,5-bis(N,N-dibutyl dithiocarbamyl)-1,3,4-thiadiazole, or 2,5-bis(N,N-dioctyl dithiocarbamyl)-1,3,4-thiadiazole, or 2-N,N-dialkyl dithiocarbamyl-5-mercapto-1,3,4-thiadiazoles such as 2-N,N-dibutyl dithiocarbamyl-5-mercapto-1,3,4-thiadiazole or 2-N,N-dioctyl dithiocarbamyl-5-mercapto-1,3,4-thiadiazole, or triazole derivatives such as 1-alkyl-2,4-triazoles such as 1-di-octyl aminomethyl-2,4-triazole. One, or a combination of more than one, of these metal deactivators may be employed in a range of 0.01 to 0.5 wt % with respect to 100 wt % of the lubricating oil composition.

An anti-foaming agent may also be added in order to confer anti-foaming properties on the lubricating oil composition according to the present invention. Examples of anti-foaming agents suitable for use with the present invention include alkanosilicates such as trimethyl polysiloxane, diethyl silicate, or fluorosilicone, or non-silicone anti-foaming agents such as polyalkylacrylates. These may be employed either alone or in a combination of two or more thereof, in a range of 0.0001 to 0.1 weight parts with respect to 100 weight parts of base oil.

As anti-emulsifiers suitable in the present invention, there may be mentioned by way of example known anti-emulsifiers that are employed as ordinary lubricating oil additives. These may be employed in a range of 0.0005 to 0.5 wt % with respect to 100 wt % of the lubricating oil composition.

EXAMPLES

The present invention is specifically described below with reference to Examples and Comparative Examples: however, the present invention is not restricted solely to these examples.

In preparation of the Examples and Comparative Examples, the following constituent materials were prepared.

1. Poly-alpha-olefins (PAO)

(1-1) low-viscosity poly-alpha-olefins of kinetic viscosity 3.91 $mm^2/s$ at 100° C.; and (1-2) high-viscosity poly-alpha-olefins of kinetic viscosity 38.6 $mm^2/s$ at 100° C.;

2. Ester compound: polyol ester:

(2-1) polyol ester TMP (ester of trimethylpropane and C8 and C10 alkanoic acids) of kinetic viscosity 4.42 $mm^2/s$ at 100° C.;

(2-2) polyol ester PE (ester of pentaerythritol and C5, C7 and C9 alkanoic acids)

Kinetic viscosity 5.6 $mm^2/s$ at 100° C.;

(2-3) di-ester DE (ester of sebacic acid and 2-ethylhexyl alcohol).

Kinetic viscosity 3.1 $mm^2/s$ at 100° C.

3. Mineral oil: mineral oil of API group III of kinetic viscosity 4.21 $mm^2/s$ at 100° C.;

4. Viscosity index improving agent: polymethacrylate of weight average molecular weight 10,000 to 100,000; and 5. Sulfur and/or phosphorus-based extreme pressure agent: an extreme pressure agent package was employed, in which were blended for example a sulfurized olefin and acidic phosphoric ester amine salt, the phosphorus content being about 1.4%, and the sulfur content being about 22%.

Examples 1 to 2

Comparative Examples 1 to 5

The lubricating oil compositions of Examples 1 to 2 and Comparative Examples 1 to 5 were prepared in accordance with the compositions shown in Table 1 and Table 2, using the above constituent materials.

The following tests were conducted in order to ascertain the performance of the Examples and Comparative Examples.

LFW-1 Test

The test was conducted using a Falex Block-On-Ring test machine (ordinary designation: LFW-1 test machine) as specified in ASTM D2714. The test conditions were: test rotational speed: 750 revolutions per minute; test load: 4.536 kg (10 lbs); test temperature: 135° C.; test time: 60 minutes.

Evaluation was conducted by measuring the depth of wear (units: mm) of the block after completion of the test.

Test on Actual Chassis-Evaluation of Durability

Tests were conducted using Example 1 and Comparative Example 2 as typical examples.

A test was conducted by driving a rear differential for, an FR type car of exhaust 3 litre to 4 litre class with a motor with a prescribed load applied. The test conditions were: average rotational speed: 5000 revolutions per minute and average load torque 150 Nm; a high-speed pattern and acceleration pattern were repeated for 100 cycles.

Evaluation was conducted by visually checking the condition of the rear differential after completion of the test.

Test on Actual Chassis-Oil Temperature Lowering Performance

Tests were conducted using Example 1 and Comparative Example 2 as typical examples.

A test was conducted by driving a rear differential for an FR type car of exhaust 3 litre to 4 litre class with a motor with a prescribed load applied. The test conditions were: rotational speed: 6000 revolutions per minute and average load torque 150 Nm; evaluation was conducted by measuring the torque loss at temperatures of 100 to 160° C. (10° C. intervals).

SRV Friction Test

Under a certain load and temperature, a ball is slid on a disk in reciprocating movement. This testing method is well known as a lubricating tester. This test is suitable for evaluating anti-fretting performance.

Test condition: Load 150N, amplitude 1 mm, oil temperature 80° C., test period 2 hours.

The depth of wear on the disk was measured (unit: micron meter) after the test.

Low Temperature Viscosity

Conformable to ASTM D2983, viscosity was measured at −40° C. For satisfying specification of 75 W the viscosity required to be lower than 150 Pa·s.

Test Results

The test results are shown in Table 1 and Table 2.

Discussion

As is clear from the test results shown in Table 1 and Table 2, little wear, specifically, 0.30 mm, was displayed in the LFW-1 test in the case of Example 1 and Example 2i.e. these examples showed excellent anti-wear performance. Furthermore, regarding Example 1, fully satisfactory durability was displayed in the Test on actual chassis-evaluation of durability, and in the Test on actual chassis-oil temperature lowering performance a high temperature lowering rate of at least 20% was displayed.

In contrast, in the case of the Comparative Examples, various defects were observed in comparison with the Examples according to the invention. In Comparative Example 1, although there was little wear in the LFW-1 test, viscosity was high, so good fuel consumption saving could not be obtained. In the case of Comparative Example 2, the viscosity was lowered compared with Comparative Example 1, but considerable wear, specifically, 0.35 mm, was displayed in the LFW-1 test: thus durability was insufficient. In the case of Comparative Example 3, the viscosity was even lower than in the case of Comparative Example 2, but fairly considerable wear, specifically 0.39 mm, was displayed in the LFW-1 test. In the case of Comparative Example 4, since this contains polyol ester, wear in the LFW-1 test was somewhat improved at 0.32 mm, but, since this Comparative Example contains mineral oil of high traction, good oil temperature lowering performance could not be obtained. In the case of Comparative Example 5, since PAO of low traction was employed, good oil temperature lowering performance could be expected, but, since no polyol ester was present, the wear in the LFW-1 test was greater, at 0.34.

Also, in the case of Comparative Example 2, wear was generated at the end faces of the bearing rollers in the Test on actual chassis-evaluation of durability and fretting wear was generated at the thrust washer; also in the Test on actual chassis-oil temperature lowering performance, a value of 14% or more was obtained i.e. the hoped-for level in respect of oil temperature lowering was not achieved.

Thus, it was found that in the Example according to the present invention excellent performance as gear oil and in particular as hypoid gear oil was achieved compared with the Comparative Examples.

Further it was found that the Examples according to the present invention have good anti-fretting performance, based on the result of a SRV friction test. The fact that the kinetic viscosity at 40° C. is relatively low and the kinetic viscosity at 100° C. relatively high for the Examples according to the present invention means that they have good low energy consumption performance. And they are satisfying the requirement of 75 W. Example 1 and 2 shows good anti-wear performance from the result of LFW-1. Example 1 showed 21% temperature reduction in the real machine test and didn't show any troubles during the test. To the contrary, there are some shortcomings in comparative examples.

TABLE 1

| | Example 1 | Example 2 | Example 3 | Example 4 | Example 5 |
|---|---|---|---|---|---|
| Paraffin-based mineral oil 4.21 $mm^2/s$ @ 100° C. wt % | | | | | |
| PAO 3.91 $mm^2/s$ @ 100° C. wt % | 40 | 38 | 40 | 40 | 40 |
| PAO 38.6 $mm^2/s$ @ 100° C. wt % | 35 | 35 | 35 | 35 | 35 |
| Polyol ester TMP 4.42 $mm^2/s$ @ 100° C. wt % | 10 | 12 | 4 | 4 | |
| Polyol ester PE 5.6 $mm^2/s$ @ 100° C. mass % | | | | 6 | 10 |
| Di-ester DE 3.1 $mm^2/s$ @ 100° C. mass % | | | 6 | | |
| Viscosity index improving agent wt % | 5 | 5 | 5 | 5 | 5 |
| Sulfur/phosphorus-based extreme pressure agent wt % | 10 | 10 | 10 | 10 | 10 |
| Sulfur content: wt % | 2.3 | 2.3 | 2.3 | 2.3 | 2.3 |
| Phosphorus content: wt % | 0.13 | 0.13 | 0.13 | 0.13 | 0.13 |
| Kinetic viscosity $mm^2/s$ @ 40° C. | 71 | 71 | 68 | 68 | 73 |
| Kinetic viscosity $mm^2/s$ @ 100° C. | 12 | 12 | 12 | 12 | 12 |
| Viscosity index (VI) | 166 | 166 | 169 | 169 | 164 |
| SRV test depth of wear μm | 2 | 2 | 2 | 2 | 2 |
| Condition: load 150N, vibration 50 Hz, Amplitude 1 mm, temperature 80° C., test period 2 hours | | | | | |

TABLE 1-continued

| | Example 1 | Example 2 | Example 3 | Example 4 | Example 5 |
|---|---|---|---|---|---|
| Low temperature viscosity Pa · s × @ 40° C. | 30 | 30 | 30 | 30 | 30 |
| LFW-1 test conditions: 750 rpm, 10 lb, 135° C., 60 min block wear depth mm | 0.30 | 0.30 | | | |
| Results of test on actual chassis | | | | | |
| 1. Durability evaluation<br>Test rig used: exhaust 3 L to 4 L class, FR car rear differential<br>Test conditions: average rotational speed 5000 rpm × load torque 150 Nm: high-speed pattern and acceleration pattern<br>Test time: 100 cycles | No problems | | | | |
| 2. Oil temperature lowering performance<br>Test rig used: exhaust 3 L to 4 L class, FR car rear differential<br>Test conditions: average rotational speed 6000 rpm × average load torque 150 Nm<br>Oil temperature 100 to 160° C. (10° C. intervals) | 21% | | | | |

TABLE 2

| | Comparative Example 1 | CE* 2 | CE 3 | CE 4 | CE 5 |
|---|---|---|---|---|---|
| Paraffin-based mineral oil 4.21 $mm^2/s$ @ 100° C. wt % | 30 | 55.25 | 90 | 30 | |
| PAO 3.91 $mm^2/s$ @ 100° C. wt % | | | | | 45 |
| PAO 38.6 $mm^2/s$ @ 100° C. wt % | 60 | 29.75 | | 50 | 40 |
| Polyol ester TMP 4.42 $mm^2/s$ @ 100° C. wt % | | | | 10 | |
| Viscosity index improving agent wt % | | | | | 5 |
| Sulfur/phosphorus-based extreme pressure agent wt % | 10 | 10 | 10 | 10 | 10 |
| Sulfur content: wt % | 2.3 | 2.3 | 2.3 | 2.3 | 2.3 |
| Phosphorus content: wt % | 0.13 | 0.13 | 0.13 | 0.13 | 0.13 |
| Kinetic viscosity $mm^2/s$ @ 40° C. | 128 | 65 | 20 | 70 | 71 |
| Kinetic viscosity $mm^2/s$ @ 100° C. | 17 | 11 | 4 | 11 | 12 |
| Viscosity index (VI) | 145 | 162 | 95 | 148 | 166 |
| SRV test depth of wear μm<br>Condition: load 150N, vibration 50 Hz, Amplitude 1 mm, temperature 80° C., test period 2 hours | 5 | 5 | 5 | 2 | 5 |
| Low temperature viscosity Pa · s × @ 40° C. | >150 | 90 | >150 | >150 | 30 |
| LFW-1 test conditions: 750 rpm, 10 lb, 135° C., 60 min block wear depth mm | 0.24 | 0.35 | 0.39 | 0.32 | 0.34 |
| Results of test on actual chassis | | | | | |
| 1. Durability evaluation<br>Test rig used: exhaust 3 L to 4 L class, FR car rear differential<br>Test conditions: average rotational speed 5000 rpm × average load torque 150 Nm: high-speed pattern and acceleration pattern<br>Test time: 100 cycles | | Wear generated at end faces of bearing rollers<br>Wear generated at thrust washer | | | |
| 2. Oil temperature lowering performance<br>Test rig used: exhaust 3 L to 4 L class, FR car rear differential<br>Test conditions: average rotational speed 6000 rpm × load torque 150 Nm<br>Oil temperature 100 to 160° C. (10° C. intervals) | | 14% | | | |

*Comparative Example.

What is claimed is:

1. A lubricating oil composition comprising a mixture of a poly-alpha-olefin and an ester compound made from trimethylolpropane and C8 and C10 alkanoic acids, the lubricating oil composition having an SAE viscosity grade of 75W-85, satisfying GL-5 in terms of API gear oil designation and having a viscosity index of 160 (according to ASTM D2270) or more.

2. The lubricating oil composition according to claim 1, wherein the poly-alpha-olefin and the ester compound are present in an amount of from 75 to 90 wt % as a mixture based on the total amount of the composition.

3. The lubricating oil composition according to claim 2, wherein the poly-alpha-olefin is a mixture of a poly-alpha-olefin having a kinetic viscosity of from 3 to 6 $mm^2/s$ at 100° C. (according to ASTM D445) and a poly-alpha-olefin having a kinetic viscosity of from 35 to 40 $mm^2/s$ at 100° C. (according to ASTM D445).

4. The lubricating oil composition according to claim 3, wherein the poly-alpha-olefin having a kinetic viscosity of from 3 to 6 $mm^2/s$ at 100° C. constitutes an amount of more than half of the poly-alpha-olefins.

5. The lubricating oil composition according to claim 1, wherein the ester compound is an ester compound having a kinetic viscosity of from 3 to 6 $mm^2/s$ at 100° C. and is present in an amount of not more than 20 wt % based on the total amount of the composition.

* * * * *